United States Patent [19]

Mishoe et al.

[11] 4,212,003

[45] Jul. 8, 1980

[54] ROBBERY WARNING DEVICE CONTAINING SELECTIVELY ACTUATABLE INFORMATION BEARING AND WARNING DISPLAYS

[75] Inventors: Terry L. Mishoe, Thomasville; Walton E. Peatross, High Point, both of N.C.

[73] Assignee: Edward N. Post, High Point, N.C.

[21] Appl. No.: 898,898

[22] Filed: Apr. 24, 1978

Related U.S. Application Data

[63] Continuation-in-part of Ser. No. 592,635, Jul. 2, 1975, abandoned.

[51] Int. Cl.[2] ..... G08B 13/00; G09F 9/48

[52] U.S. Cl. ..... 340/574; 40/545; 340/366 E; 340/691

[58] Field of Search ..... 340/574, 331, 376, 691, 340/366 E, 759, 773, 378.1; 315/135; 40/545, 902

[56] References Cited

U.S. PATENT DOCUMENTS

| | | | |
|---|---|---|---|
| 1,946,781 | 2/1934 | Davidson | 340/574 |
| 2,025,356 | 12/1935 | Neal | 40/545 |
| 2,770,690 | 11/1956 | Sanders | 340/574 |
| 3,085,224 | 4/1963 | Becka | 40/545 |
| 3,947,986 | 4/1976 | Page | 340/574 |

*Primary Examiner*—Glen R. Swann, III

*Attorney, Agent, or Firm*—Clarence A. O'Brien; Harvey B. Jacobson

[57] ABSTRACT

A translucent panel covers an open side of a frame. A neon sign forming a warning message is disposed within the frame adjacent and facing the panel so as to be visible from the outward facing panel only when the neon sign is illuminated. Stroboscopic lamps are mounted in the frame beneath the neon sign for actuation together with the neon sign in order to attract attention to the warning being displayed through the panel whenever the neon sign is actuated by the closing of a switch conveniently disposed at a teller's cage or station, a cash register, and the like.

4 Claims, 5 Drawing Figures

Pilot Lamp
J2-3
1st Prim.
J2-6
2nd Prim.
J2-4
Pilot Lamp
J2-5
Service
J2-1
Common
J2-2
N.O. Sw.
J1-1
Sw. Comm.
J1-2
N.C. Sw.
J1-3
60
66
62
46
68
44
42
117VAC
54
56
58
12VAC
74
50
25VAC
to 80'
70
72
48
28, 28'
88
80
Anodes
Triggers
Collectors
output A
output B
output C
Strobe
Input AJ-3-1
Input BJ-3-3
90 to 48
(Fig. 4)
82
80'
94
84
86
90
88
96
74
Oscillator
Rectifier Bridge
Strobe light
28, 28'

ROBBERY WARNING DEVICE CONTAINING SELECTIVELY ACTUATABLE INFORMATION BEARING AND WARNING DISPLAYS

CROSS REFERENCE TO A RELATED APPLICATION

This application is a continuation-in-part of our U.S. application Ser. No. 592,635, filed July 2, 1975, now abandoned and also entitled Robbery Warning Device.

BACKGROUND OF THE INVENTION

1. Field of the Invention

This invention relates generally to a robbery signal device, and particularly to a sign displayable outside a place of business for warning of a robbery taking place within the place of business.

2. Description of the Prior Art

The risk to merchants, banks, and the like, from armed robbery and similar crimes is a serious problem in our morally decaying and economically troubled society. The situation has reached a point where many businesses today experience such high instances of robberies that police-stakeouts are maintained in the vicinity of such businesses. To compound the problem, persons in the vicinity of a robbery, or passing by the scene of the crime in a motor vehicle or other conveyance, are unaware that a crime is being committed and, accordingly, fail to note descriptions and license plate numbers of get-away cars, description of persons leaving the scene of the crime, and other information useful to law enforcement officers in either stopping the crime while it is in progress or eventually apprehending the perpetrator or perpetrators of the crime.

As can be appreciated, if a merchant, banker, or other business or professional person being robbed could alert persons in the vicinity of the crime, the police would stand a better chance of having outside witnesses to said crime resulting in more arrests and convictions of robberies. Outside witnesses would be able, without risk to themselves, to get car descriptions and possibly license numbers of get-away vehciles used by the robbers. Further, the witnesses would be able to give better descriptions of the thieves inasmuch as the witnesses were forewarned of the robbery taking place and would be in a position to get a good look at the robbers without endangering their own lives. Most importantly, outside witnesses would be able to notify police or the local authorities of a robbery taken place, resulting in quicker action being taken to apprehend the criminals and hopefully to interrupt the robbery, or similar crime, while same is still in progress.

Another significant advantage of a device which warns the public that a robbery is taking place in a place of business is that such warning will prevent the public from walking into the place of business and being involved in the robbery.

Accordingly, it has been proposed to provide various visual warnings of a robbery, and the like, being committed within a building, or part of a building, outside of which a warning sign, actuable from within the building is displayed. Examples of such devices previously proposed may be found in U.S. Pat. Nos. 1,267,911, issued May 28, 1918 to M. Schoulder; 1,964,353, issued June 26, 1934 to S. J. Hodos; 2,518,979, issued Aug. 15, 1950 to J. R. Davidson; 2,770,690, issued Nov. 13, 1956 to T. J. Sanders; and 2,803,810, issued Aug. 20, 1957 to E. M. Evans et al. A major disadvantages of these known warning devices, however, which has prevented the devices form becoming popular and in general use, is that they fail to alert persons except those in the immediate vicinity of the place of business being robbed. In this day of the automobile when a great many banks. fast-food businesses, and the like, are located along highways where the only passerbys are in motor vehicles and similar conveyances, it is necessary that the warning be visible to persons passing by the place in a vehicle. Further, when police stake-outs are resorted to, it is necessary that such a warning sign be seen at a substantial distance from the place of business, say one-fourth to one-half mile, so the law enforcement officer can be watching a place of business, and preferably several places of business, from a substantial distance without being conspicuous to perpetrator or perpetrators of the crime.

In addition, these known devices usually are conspicuous when not in actual use. U.S. Pat. No. 3,913,092, issued Oct. 14, 1975 to G. R. Klingenberg, discloses an example of an illuminated sign formed by indicia disposed on a transparent face of a sign so that the indicia is visible at all times. Further, U.S. Pat. Nos. 3,089,060, issued May 7, 1963 to Horino, and 3,694,062, issued Sept. 26, 1972 to Koenig, are pertinent as disclosing examples of a blinking signalling device and a stroboscopic display, respectively.

U.S. Pat. No. 2,998,667, issued Sept. 5, 1961 to J. W. Darnel, et al, discloses a message conveying apparatus employing fluorescent tubes in a normally blacked-out display, while U.S. Pat. No. 3,780,284, issued Dec. 18, 1973 to F. A. Dewhirst sets forth a lamp enclosure in which a neon lamp is employed to illuminate a message provided on a translucent lens. In addition, U.S. Pat. No. 1,946,781, issued Feb. 13, 1934 to W. H. Davidson, discloses an example of a control system for use with alarm systems for banks and the like.

SUMMARY OF THE INVENTION

It is an object of the present invention to provide a device which will save lives and the loss of property by deterring and stopping robberies and facilitating apprehension of criminals.

It is another object of the present invention to provide a warning device which will give a merchant, banker, or the like, a deterrent to armed robbers, and the like, who would rob more readily if the device according to the invention was not on the premises of the business.

It is yet another object of the present invention to give a merchant, banker, and the like, a normally useful sign device capable of alerting persons in the vicinity of a robbery in progress of the robbery without making a noise which would also alert the robber or robbers.

It is a still further object of the present invention to provide a warning device able to convey the message of a robbery, and the like, in progress to the public and to law enforcement officers on routine patrol in business areas, in a manner quickly seen and easily understood.

These and other objects are achieved accordng to the present invention by providing a robbery warning device having: a frame provided with a through opening; a translucent panel mounted on the frame and covering the through opening and having a pair of spaced, substantially parallel faces; neon lamps disposed within the frame adjacent an inner one of the faces of the panel and arranged forming a message which is normally not visible when viewed from the outer of the faces of the panel, the message formed by the neon lamps being visible when viewed from the outer of the faces of the panel when the neon lamps are energized; and a stroboscopic lamp mounted in the frame beneath the neon sign for actuation when the aforementioned neon lamps illuminate the panel so as to attract attention to the message seen through the panel.

According to a preferred construction of the present invention, the frame is substantially rectangular in configuration, and includes four substantially planar peripheral edge walls and a planar back wall, with the translucent panel forming a front wall. As will be appreciated, the front panel and back wall which are in spaced relationship with respect to one other, although substantially parallel, cover the opening provided in the frame. Advantageously, there are a pair of stroboscopic lamps disposed in opposite lower corners of the rectangular framework, with the neon sign being arranged immediately above the stroboscopic lamps.

A suitable electronic control circuit is advantageously provided for actuating the neon lamps and the stroboscopic lamps upon the closing of a switch which may be disposed within the place of business being robbed. This control circuit advantageously has associated with it a flasher circuit connected to the stroboscopic lamps for actuating the stroboscopic lamps in such a manner as to attract attention to the sign.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing a robbery warning device according to the present invention mounted on the wall of a building housing a bank, and the like.

DESCRIPTION OF THE PREFERRED EMBODIMENTS

Figure 1:
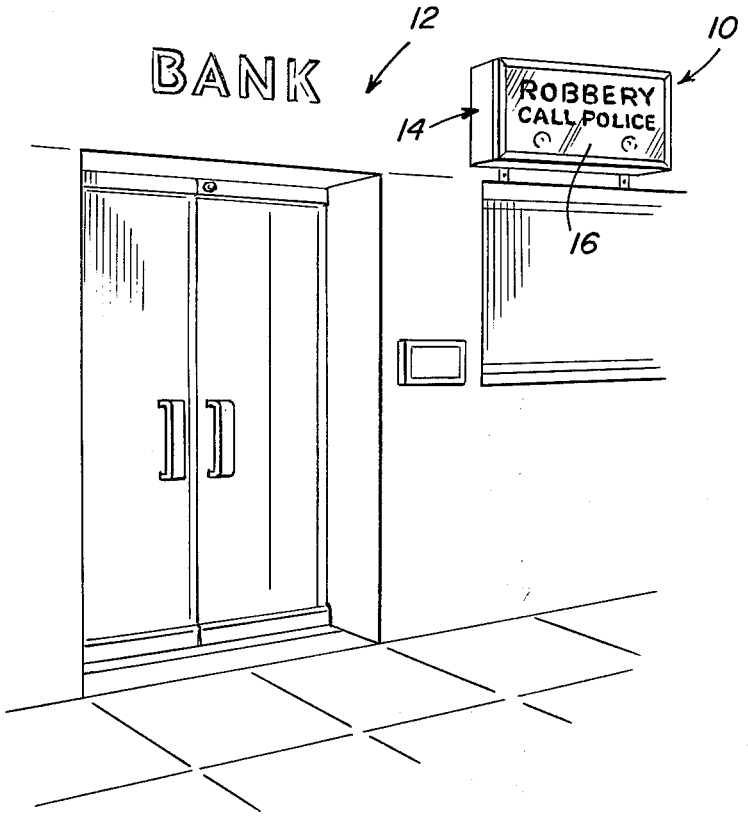

Referring now more particularly to FIG. 1 of the drawings, a robbery warning device 10 according to the present invention is illustrated as mounted on the outer, or streetfacing, wall of a building 12 exemplified as housing a bank, although it is to be understood that the device 10 may be used in conjunction with any business. Although not specifically illustrated, device 10 could be mounted on top of a pole or post in a conventional manner.

Figure 2:
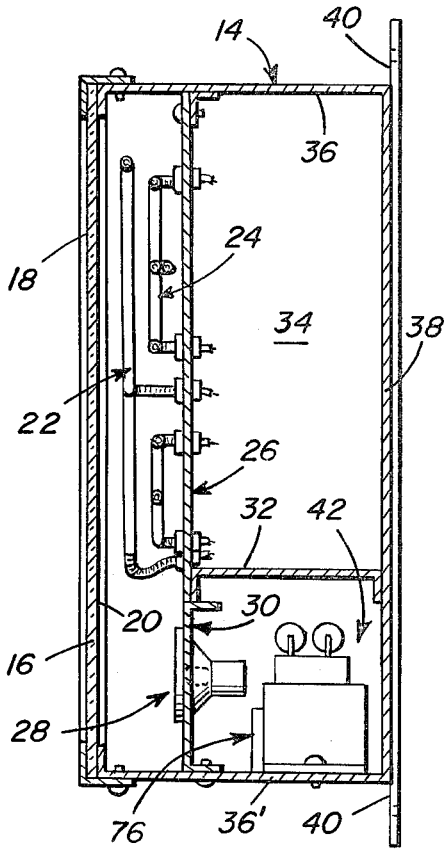
FIG. 2 is a fragmentary, front elevational view, partly cut away, showing to a larger scale the robbery warning device of FIG. 1.
Figure 3:
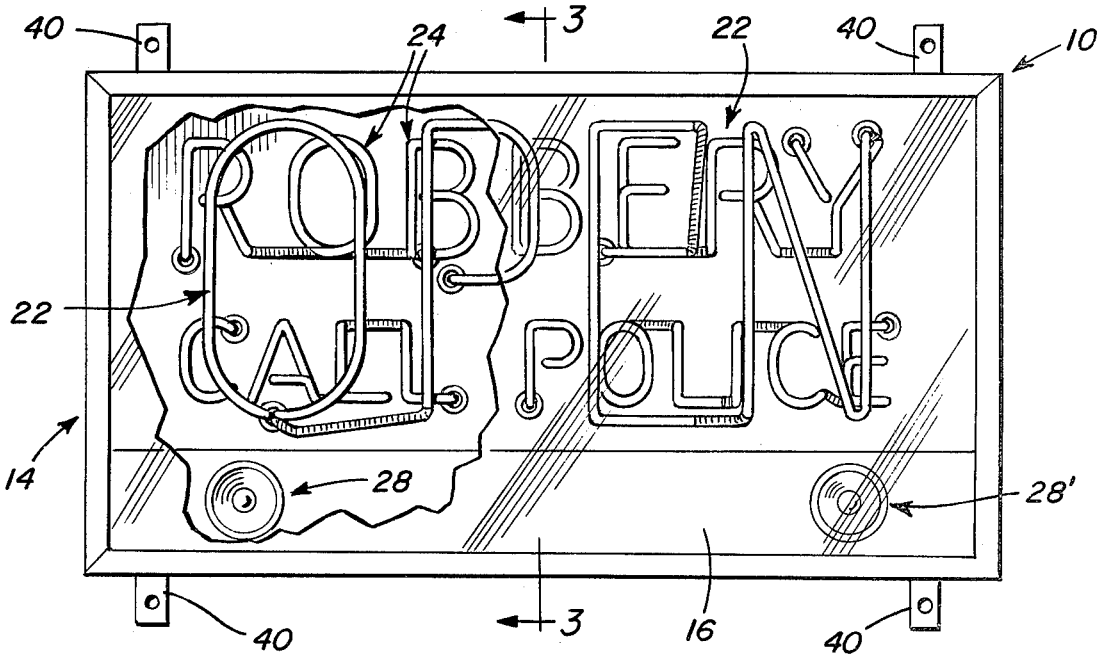
FIG. 3 is a fragmentary, sectional view taken generally along the line 3—3 of FIG. 2, but drawn to a larger scale.

Referring now more particularly to FIGS. 2 and 3 of the drawings, device 10 includes a frame 14 provided with a through opening over one side of which a translucent lens or panel 16 is mounted. Panel 16 has a pair of substantially parallel faces 18 and 20, of which face 18 faces outwardly of frame 14 and face 20 faces inwardly thereof. Neon signs 22 and 24 are superimposed on one another adjacent face 20 of panel 16 for being selectively, and alternatively illuminated in order to render the message formed by the respective signs 22 and 24 visible when viewed from beyond face 18 of panel 16. As illustrated, sign 22 is constructed from neon tubes or lamps in a conventional manner so as to form the word "open", while sign 24 is constructed in a similar manner so as to form the message "robbery call police". Since the construction of neon signs is well known and commonplace, the details of construction of the neon signs 22 and 24 will not be described in greater detail herein. As can be appreciated, however, the translucent panel 16 prevents the messages on the sign 22 and 24 from being read except when the respective signs 22 and 24 are energized so as to give off light radiation. Panel 16 may be constructed from a sheet of a, for example, thermoplastic polycarbonate resin, such as that sold by the General Electric Company under the trademark "Lexan", while frame 14 can be fabricated using conventional techniques from aluminum, and the like.

The neon signs 22 and 24 are mounted on a common mounting plate 26 arranged spaced from, but substantially parallel to, panel 16 and extending from the top of frame 14 toward, but spaced from, the bottom thereof. Arranged below signs 22 and 24 are a pair of stroboscopic lamps 28 and 28′ appropriately mounted on a faceplate 30 arranged beneath and forming a downward extension of the mounting plate 26. As can be seen from FIG. 3, the plates 26 and 30 are provided with appropriate flanges and angles for facilitating attachment thereof to frame 14 and to a deck 32 which extends from adjacent the junction of plates 26 and 30 to the back of frame 14. More specifically, frame 14 is provided with a pair of side walls (one of which, 34, is seen in FIG. 3) and 34′, a top wall 36, a bottom wall 36′, and a back wall 38. The latter is disposed substantially parallel to panel 16, while the side, top, and bottom walls are arranged substantially perpendicular to panel 16 and back wall 38 so as to extend transversely between same.

The stroboscopic lamps 28 and 28′ are of conventional construction, and are disposed in spaced relation adjacent respective lower corners of frame 14. Extending outwardly from top wall 36 or bottom wall 36′ adjacent respective end walls 34 and 34′ of frame 14 are a plurality of lugs 40 which facilitate attachment of frame 14 to the wall of a building 12, and the like. Disposed beneath the deck 32, and behind the faceplate 30, are the various elements of the electrical control circuit according to the present invention for actuating signs 22 and 24 and stroboscopic lamps 28 and 28′.

Figure 4:
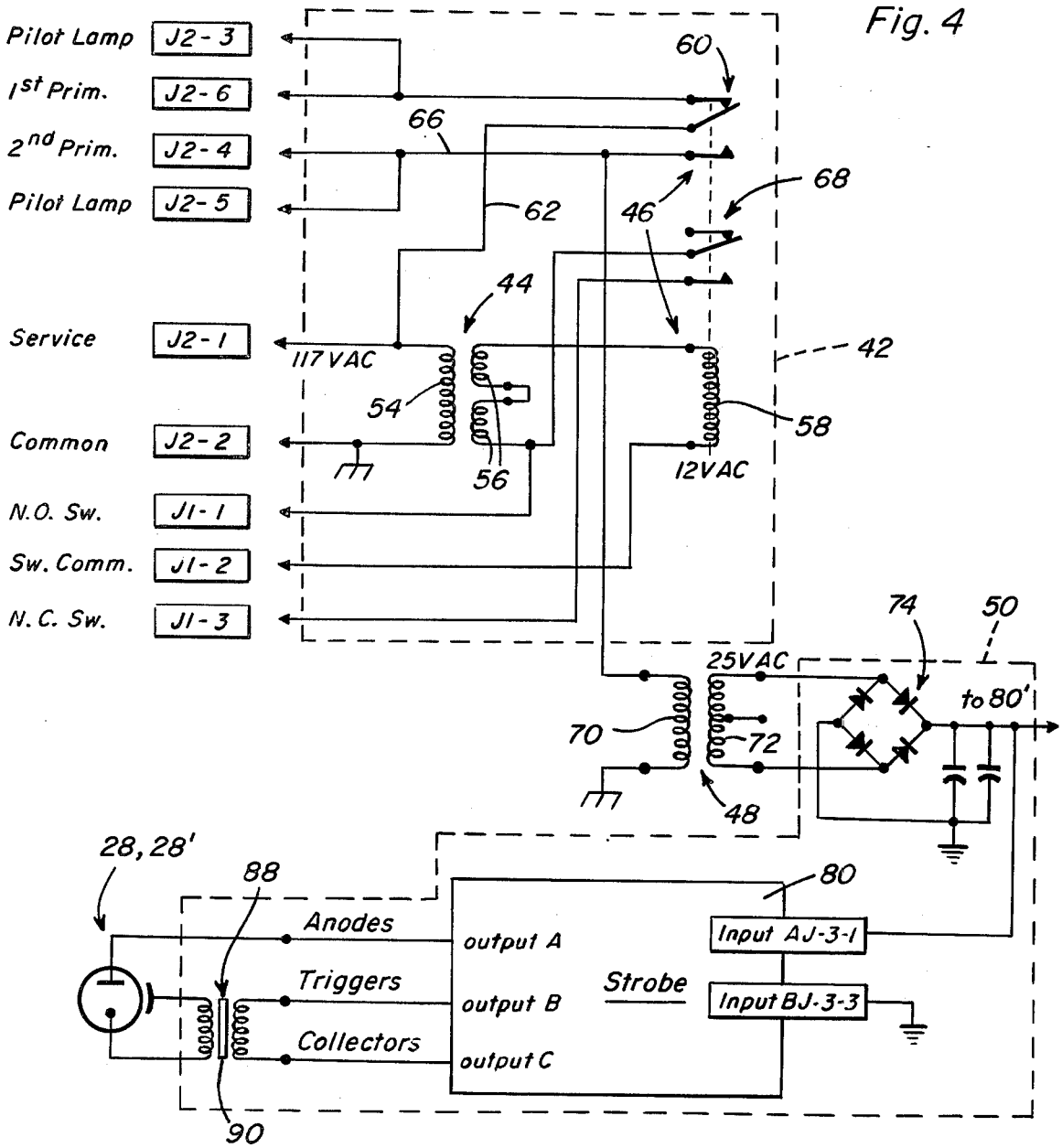
FIG. 4 is a schematic diagram showing an electronic control circuit according to the present invention for actuating the robbery warning device seen in FIGS. 1–3.

FIG. 4 of the drawings shows a schematic diagram of an electrical control circuit 42 advantageously provided for actuating the neon tubes of signs 22 and 24 and the stroboscopic lamps 28 and 28′. This circuit 42 advantageously includes a transformer 44, a relay 46, a second transformer 48, and a flasher circuit 50 all connected to a suitable power source and to lamps 28 and 28′ as appropriate.

Transformer 44 is a standard 2-coil winding transformer, such as that manufactured by the Signal Transformer Company, Inc., part designation TC12-200, with a primary rating of 120 volts, 60 hertz, and a secondary rating of 12.6 volts and center tap 2 amperes. Primary 54 of transformer 44 is connected to a suitable source of power, such a conventional 110 to 120 volt ac electrical outlet, with a conventional normally-open switch (not shown) being connected in series with secondary 56 of transformer 54 by use of the conventional jacks indicated J1-1 and J1-2. Relay 46, which can be a "Potter and Brumfield" Part No. KRP11AG, includes a coil 58 connected in series with the secondary 56 of transformer 44 and with the aforementioned normally-open switch connected to jacks J1-1 and J1-2. Relay 46 further includes a first set 60 of contacts connected to one side 62 of the aforementioned power source, preferably through a conventional fuse (not shown) for providing protection to the relay contacts. Flasher circuit 50 is connected to side 66 of set 60 of contacts of relay 58, and to jack J2-4, and to the common jack J2-2 by means of a ground to the chassis (not shown) of the circuit.

Relay 46 further includes a second set 68 of contacts which are normally open and which are connected to the secondary 56 transformer 44 and to a normally-closed switch (not shown) by means of jack J1-3. This set 68 of contacts are in the form of suitable, known self-locking contacts for closing on energization of coil 58 and locking so as to retain coil 58 in its energized state when the normally-open switch connected to jacks J1-1 and J1-2 is closed. The normally-closed switch connected to jacks J1-2 and J1-3, which could be, for example, a conventional microswitch, is connected to secondary 56 of transformer 44 and set 68 of contacts of relay 46 for permitting relay 46 to be selectively de-energized and reset.

Transformer 48 has a primary 70 connected to side 66 of the set of contacts 60, which side 66 is in turn connected to jack J2-4 which places in communication with the source of electrical power the primary of a conventional gas tube sign transformer 76 (FIG. 3) having a primary rated at, for example, 120 volts, 60 hertz, 360 volt-amperes, and a secondary rated at 12,000 volts and 30 milliamperes. The jack J2-6 which is connected to the third terminal of the set 60 of contacts is in turn connected to the primary of another gas tube sign transformer, similar to transformer 76 attached to jack J2-4. The transformer associated with jack J2-6 is connected to the neon sign 22, while the transformer associated with jack J2-4 is connected to the neon sign 24.

Conventional pilot lamps (not shown) are associated with jacks J2-3 and J2-5 for giving an indication of energization of the transformers associated with the jacks J2-6 and J2-4, respectively.

As has been indicated from the above description, the jacks J1-and sequence and J2-and sequence are shown in FIG. 4 as outside of the broken line indicating circuit 42. This was done intentionally to demonstrate that the, for example, two neon tube sign transformers are disposed within frame 14 in separate housings from circuit 42, and to illustrate that the normally open and normally closed switches associated with jacks J1-1, J1-2 and J1-3 would be disposed completely outside of frame 14 usually at a remote location within a building being protected. In particular, there may be more than one normally-open switch arranged in parallel at various locations about a building being protected, and they should be located adjacent a teller's cage or station, a cash register, safe, and the like, for being manually closed by a hand, the body, or one's foot when a crime is being committed.

The lower portion of FIG. 4 showns a flasher circuit 50, partially incorporating the oscillator portion 80 of a conventional strobe unit, which is connected to the source of electrical power by transformer 48. This transformer 48, which can be a standard two-winding transformer, such as manufactured by the Radio Shack Division of the Tandy Corporation, part 273-1512, having the primary 70 rated at 120 volts 60 hertz, and a secondary 72 rated at 25.2 volts and 2 amperes. As seen in FIG. 4, a rectifier bridge 74 is connected across the secondary 72 of transformer 48, and has the output thereof connected to oscillator portion 80 as by an input jack AJ3-1. Another input jack designated BJ3-3 is grounded, while three outputs designated A, B and C connect oscillator 80 to lamps 28, 28'.

Figure 5:
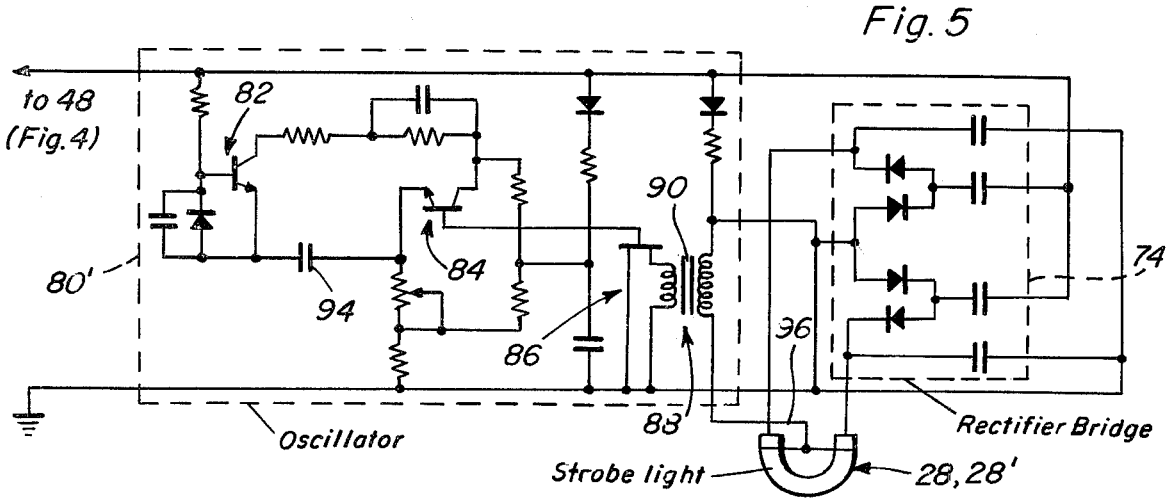
FIG. 5 is a schematic diagram showing a flasher circuit for use with the electronic control circuit of FIG. 4.

Referring now to FIG. 5 of the drawings, a flasher circuit is illustrated that is slightly different than the circuit seen in FIG. 4, but can be used in the circuit of FIG. 4 as the flasher circuit. As can be seen from FIG. 5, oscillator 80' is constructed from a pair of NPN, transistors 82 and 84 and a field-effect transistor 86, together with a saturable-core high voltage transformer 88 having a saturable-core 90. Rectifier bridge 74' insures a steady direct current being fed to the anode of lamps 28, 28', with the latter being, for example, a conventional stroboscopic lamp such as a coldcathode or glow tube commonly referred to as a strobotron.

As can be readily understood from the schematic diagram shown in FIG. 5, transistors 82 and 86 are normally ON, and transistor 84 is OFF. Core 90 of transformer 88 will saturate after a predetermined time which is a function of the values of the various elements in circuits 50. Once core 90 saturates, field-effect transistor 86 goes OFF due to the resulting change in the bias on the gate of transistor 86, which gate is connected directly to the base of transistor 84. Transistor 82 also goes OFF. As transistor 84 comes ON, capacitor 94 charges and eventually causes transistor 82 to come ON once again. As transistor 82 comes ON, transistor 84 goes OFF and transistor 86 comes ON. While core 90 of transformer 88 is saturated, current is diverted through wire 96 to the cathode of lamp 28, 28' in order to cause lamp 28, 28' to flash. Opening of the circuit through transistor 86, however, will cause core 90 to de-saturate, and the above cycle will repeat continuously on a predetermined time base.

Although only a single lamp 28, 28' is illustrated in FIGS. 4 and 5, it is to be understood that it is contemplated that separate lamps will be provided arranged in parallel by connection to the same terminals as the single lamp illustrated.

OPERATION OF THE DEVICE

The, for example, 115 to 120 volt ac current from the power source goes initially into transformer 44 and the set 60 of the contacts of relay 46. Transformer 44 provides voltage to coil 58 of relay 46 in order to energize the coil 58 when a normally-open switch associated with the jacks J1-1 and J1-2 is closed by an operator (not shown). This switch, or switches in parallel in the conventional manner not shown, can be placed near one or more tellers or store operators at the owner's discretion. When the switch is closed, coil 58 is energized and set 60 of the contacts of relay 46 are closed in order to complete a circuit from the power source to the transformer 48 and to the primary of the transformer associated with jack J2-4 and sign 24. Before coil 58 is energized, however, set 60 of the contacts of relay 46 are closed as seen in FIG. 4 so as to energize the transformer associated with sign 22 by means of jack J2-6. That is, normally the neon sign 22 which says "OPEN" will be energized so as to indicate to potential customers that the establishment being protected is open for business. Once the normally-open switch is closed and coil 58 energized, however, the set 60 of contacts of relay 46 will flip to the opposite position as seen in FIG. 4 so as to complete a circuit from jack J2-1 and pass the electrical power into side 66 of set 60, primary 70 of transformer 48, and jack J2-4. The self-locking contacts of set 68 of the contacts of relay 46 also close upon energization of coil 58 in order to keep relay 46 energized until such time as the normally-closed switch associated with jacks J1-2 and J1-3, which may be a conventional reset spring loaded toggle switch, is opened in order to reset relay 46. This latter switch is also advantageously kept in a hidden or locked location to avoid tampering with the system.

Thus, when the normally-open switch is closed in order to energize coil 59 or relay 46, neon sign 22 is de-activated, neon sign 24 is activated, and power is fed through transformer 48 and into the flasher circuit 50 in order to actuate the strobe lamp 28 and 28'. The pilot lamps associated with jacks J2-3 and J2-5 will provide a visual indication of which neon sign is in operation at any time, and since one of these signs is intended to be operated at all times when the establishment being protected is open for business, these pilot lamps will also give visual indication that power is present in circuit 42.

SUMMARY

As will be readily understood from the description and from the drawings, device 10 is normally a lighted sign not sufficiently lighted to necessarily attract attention of the public in a world littered with signs. Accordingly, stroboscopic lamps 28, 28' flash so brightly that device 10 becomes highly visible even in broad daylight as well as at night, and readily draws the needed attention to the neon sign 24 with which the lamps 28, 28' are associated. The size of the sign itself will vary to a customer's wants and needs, and as mentioned above can be attached to the outside of a building as to an exterior wall or a roof top.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A robbery warning device, comprising, in combination:

(a) a frame, said frame being substantially rectangular and including four substantially planar peripheral edge walls defining a through opening;

(b) a translucent panel mounted on the frame over the through opening forming a front wall thereof, and having a pair of spaced, substantially parallel faces;

(c) lamp means forming a sign and disposed within the through opening adjacent a one of the faces of the panel directed inwardly of the frame for being selectively energized and making visible through the translucent panel the sign formed by the lamp means, the lamp means including a first neon sign and a second neon sign disposed in superimposed relationship within the frame, said first neon sign being structured to provide a mundane message or advertisement, said second neon sign being structured to produce an emergency message, said first neon sign being positioned between said second neon sign and said translucent panel;

(d) strobe means mounted in the frame for actuation when the lamp means is actuated, illuminating the panel and attracting attention to the sign formed by the lamp means and made visible by the lamp means when viewed from beyond the other of the faces of the panel, which other of the faces is directed outwardly of the frame; and (e) circuit means connected to said lamp means and said strobe means for controlling selective actuation of said first neon sign, said second neon sign, and said strobe means, said circuit means including a first switch means, said first switch means being normally closed for energizing the first neon sign, and a second switch means, said second switch means being normally open and selectively alternatively energizable for providing current to said second neon sign and said strobe means in unison and deenergizing said first neon sign.

2. A structure as defined in claim 1, wherein the strobe means includes a pair of stroboscopic lamps mounted in respective lower corners of the frame and beneath the lamp means so as to be directed toward the translucent panel.

3. The structure as defined in claim 1 wherein said circuit means further includes at least one relay, said normally open switch means comprises a normally open contact of said relay and said normally closed switch means comprises a normally closed contact of said relay, and further including a third switch means, said third switch means being normally open and being positioned remotely from said lamp means for causing energization of said relay thereby opening said normally closed switch means and closing said normally open switch means simultaneously.

4. The structure defined in claim 3 and further wherein said relay is a self-locking relay.

* * * * *